US005197359A

United States Patent [19]

Mills

[11] Patent Number: 5,197,359

[45] Date of Patent: Mar. 30, 1993

[54] LOCKING WRENCHES

[75] Inventor: J. David Mills, Dauphin Island, Ala.

[73] Assignee: Blue Water Holding Company, Inc., Dauphin Island, Ala.

[21] Appl. No.: 929,492

[22] Filed: Aug. 18, 1992

Related U.S. Application Data

[63] Continuation of Ser. No. 726,658, Jul. 8, 1991, abandoned, which is a continuation-in-part of Ser. No. 583,977, Sep. 18, 1990, Pat. No. 5,052,251, which is a continuation-in-part of Ser. No. 571,202, Aug. 23, 1990, abandoned.

[51] Int. Cl.[5] ..... B25B 7/14

[52] U.S. Cl. ..... 81/324; 81/325; 81/328; 81/371; 81/372; 81/427.5

[58] Field of Search ..... 81/318-328, 81/367-384, 427.5; 7/125; 269/3, 6; 70/18, 61, 200, 237

[56] References Cited

U.S. PATENT DOCUMENTS

| | | | |
|---|---|---|---|
| 419,272 | 1/1890 | Low | 81/327 |
| 527,592 | 10/1894 | Cochran . | |
| 776,598 | 12/1904 | Kettlesen . | |
| 1,163,428 | 12/1915 | McMillen . | |
| 1,274,427 | 8/1918 | Landmann . | |
| 1,313,687 | 8/1919 | Hellweg | 81/19 |
| 1,316,407 | 9/1919 | Auperl . | |
| 1,331,793 | 2/1920 | Wojdacz | 81/324 |
| 1,377,413 | 5/1921 | Dwelle . | |
| 1,392,194 | 9/1921 | Mills . | |
| 1,398,122 | 11/1921 | Bender . | |
| 1,489,458 | 4/1924 | Petersen | 81/380 |
| 1,582,498 | 4/1926 | Wilkerson . | |
| 1,586,513 | 6/1926 | Anderson . | |
| 1,640,883 | 8/1927 | Coleman . | |
| 2,280,005 | 4/1942 | Petersen | 81/84 |
| 2,409,627 | 10/1946 | Helgeson | 81/78 |
| 2,514,130 | 7/1950 | Jones | 81/84 |
| 2,592,807 | 4/1952 | Jones | 81/84 |
| 2,606,466 | 8/1952 | Wright | 81/5.1 |
| 2,612,808 | 10/1952 | Small | 81/81 |
| 2,674,796 | 4/1954 | Herold | 81/322 |
| 4,229,924 | 10/1980 | Teachout, Sr. | 81/427 |
| 4,462,284 | 7/1984 | Gowers | 81/428 R |
| 4,889,021 | 12/1989 | Morrison | 81/325 |
| 4,893,530 | 1/1990 | Warheit | 81/409.5 |
| 4,912,949 | 4/1990 | Bowers | 70/19 |
| 4,961,742 | 10/1990 | Torre | 81/323 |
| 5,052,251 | 10/1991 | Mills | 81/324 |

*Primary Examiner*—J. J. Swann
*Attorney, Agent, or Firm*—Nixon & Vanderhye

[57] ABSTRACT

Improved locking wrenches are provided with adjustment screws having a head portion and a flange extension associated with the lower handle. A locking element is provided which serves to lockably engage a restraining element associated with one of the adjustment screw and the flange extension. In this manner, inadvertent release of the clamping force exerted between jaws of the wrench may be prevented since the lower handle is restrained from moving into its opened stated relative to the upper handle.

18 Claims, 5 Drawing Sheets

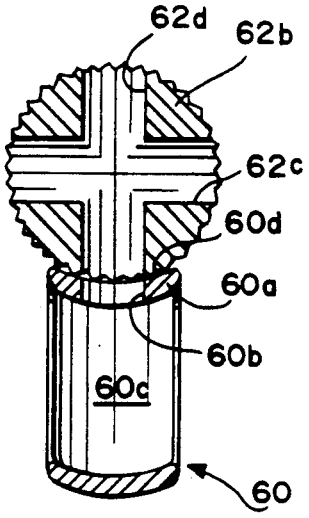
FIG. 6
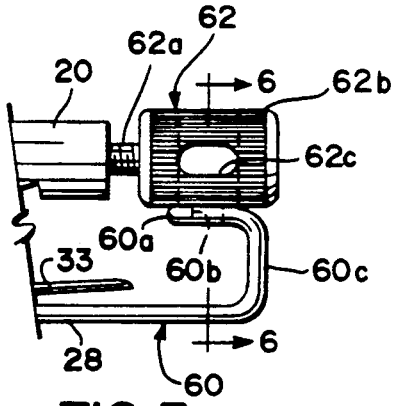
FIG. 5
FIG. 7
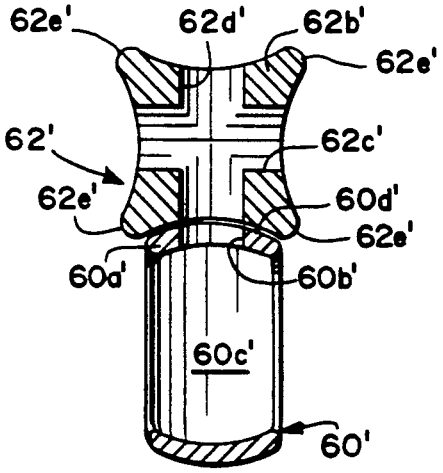
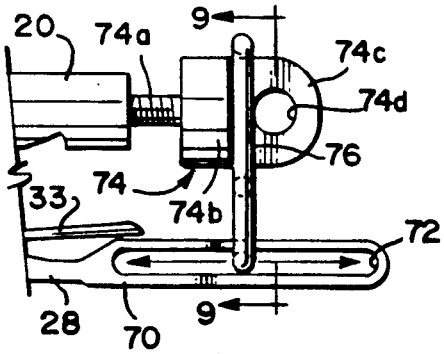
FIG. 8
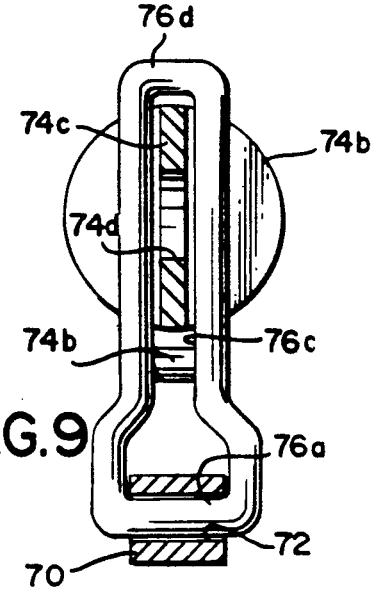
FIG. 9

LOCKING WRENCHES

CROSS-REFERENCE TO RELATED APPLICATIONS

This application is a continuation of application Ser. No. 07/726,658, filed Jul. 8, 1991 (now abandoned), which in turn is a continuation-in-part of copending U.S. application Ser. No. 07/583,977 filed on Sept. 18, 1990 (now U.S. Pat. No. 5,052,251, issued Oct. 1, 1991, which in turn is a continuation-in-part of copending U.S. application Ser. No. 07/571,202 filed on Aug. 23, 1990 (abandoned), each entitled "Improvements to Locking Wrenches", the entire contents of which are expressly incorporated hereinto by reference.

FIELD OF THE INVENTION

The present invention generally relates to locking-type wrenches. More specifically, the present invention relates to locking-type wrenches which are especially adapted such that the operating handles may be positionally restrained.

BACKGROUND AND SUMMARY OF THE INVENTION

Locking wrenches are well known tools that are employed in situations where it is desirable to clamp one structural member to another so that the operator's hands may be freed to accomplish other tasks. Examples of conventional locking wrenches include those wrenches disclosed in prior-issued U.S. Pat. Nos. 2,280,005 issued to William Peterson on Apr. 14, 1942; U.S. Pat. No. 2,514,130 issued to Harold T. Jones on Jul. 4, 1950; and U.S. Pat. No. 2,592,807 issued to Harold T. Jones on Apr. 15, 1952 (the entire content of each of these prior-issued U.S. Patents being expressly incorporated hereinto by reference).

Conventional locking wrenches are generally comprised of an upper handle having a fixed-position upper jaw at its forward end and a threaded sleeve at its rearward end. A pivotally movable lower jaw is disposed in opposition to the upper jaw and is moved towards and away from the upper jaw by means of a lower operating handle (which is itself pivotally connected to the lower jaw). A toggle lever is pivotally connected at one end to the lower operating handle, and is slidably received within the upper handle at its opposite end. Typically, a tension spring biases the lower jaw in a pivotal direction tending to separate it from the upper jaw. An adjustment screw is threadably coupled within the sleeve of the upper handle and has a terminal end that acts upon the opposite end of the toggle lever.

As those in the art will appreciate, due to the relative connections between the toggle lever, lower operating handle, and lower jaw, turning movements applied to the adjustment screw will responsively cause the lower jaw to be moved pivotally relative to the fixed upper jaw. In this manner, the clamping force that is exerted by the upper and lower jaws may be selectively adjusted by the operator. In addition, the toggle lever increases the clamping force that is applied to structural members held between the upper and lower jaws when the lower operating handle is forcibly moved into a closed condition relative to the upper handle.

While conventional clamping wrenches function to clamp structural members securely one to another, there is a risk that the clamping force may suddenly be released—e.g., as might occur should the wrench and/or structural members held by the wrench be struck by an object with sufficient force to cause the lower operating handle to be moved under the influence of the tension spring to an opened condition relative to the upper handle. Sudden releases of the clamping force may, int urn, release the structural members that had just moments before been securely clamped and allow them to strike the operator and/or others in the vicinity of the work area thereby causing potentially serious injuries.

One prior proposal for positionally retraining the upper and lower handles of a locking wrench is represented by U.S. Pat. No. 4,889,021 issued to Joseph L. to Morrison on Dec. 26, 1989. According to Morrison '021, the upper and lower handles of a locking wrench are provided with vertically aligned apertures so as to accomodate upper and lower stubs associated with an especially adapted padlock. The upper stub moreover bears against a brake means located physically within the upper handle member so as to apply braking force against the adjustment screw thereby inhibiting its turning movements.

While the locking wrench proposal in Morrison '021 appears to function in a manner that would minimize the risk of sudden release of the clamping force, it necessarily requires a separate and especially adapted padlock to always be available to the operator.

What has been needed therefore are improvements to conventional locking-type wrenches which would significantly reduce (if not eliminate entirely) the risks associated with the inadvertent sudden release of a wrench's clamping force and which would not require especially adapted restraining elements. Thus, locking-type wrenches that are inherently safer and more convenient to use have been needed. It is towards fulfilling such needs that the present invention is directed.

According to the present invention, novel locking-type wrenches are provided such that the upper and lower handles are positionally restrained or immobilized relative to one another. More specifically, preferred embodiments of the present invention include a rearwardly directed extension member that defines an aperture associated with the lower operating handle, and means associated with the adjustment screw to coact with the aperture in the lower handle flange extension so as to positionally restrain the upper and lower handles relative to one another.

According to some preferred embodiments of the present invention, the head of the adjustment screw includes pairs of radially extending wings each of which defines an opening. The extension member is rigid with the lower operating handle and is located at a position such that it may be brought into an adjacent position with one of the wings when the lower operating handle is in a closed condition relative to the upper handle. Thus, when the extension member is adjacently positioned relative to one of the wings (i.e., when the lower operating handle is in a closed condition), the respective opening defined in that one wing and the aperture defined in the extension member will be in alignment. In such a manner, a restraining element (which could be virtually any suitable rigid or flexible member, such as a bolt, pin, rod, tube, padlock hasp, wire, rope, or the like) may be passed through the aligned opening/aperture to thereby positionally restrain the upper and lower handle members relative to one another. The risk of inadvertent sudden release of the clamping force is thereby minimized (if not eliminated).

Other embodiments of the invention include apertured adjustment screw heads of selected geometrical configuration, and an opening defined in the extension member. The extension member according to these alternative embodiments will likewise be oriented so that it is adjacent to the apertured adjustment screw head when the lower operating handle member is in its closed condition so that at least one of its defined apertures will be in alignment with an opening formed in the extension member.

The handle-restraining systems of this invention may also include an integral locking assembly provided operatively with the adjustment screw and the lower operating handle so that the respective restraining elements may be coupled structurally one to another to thereby physically restrain the lower operating handle relative to the upper handle. Thus, the extension member may include a movable restraining element that defines an opening. The restraining element may be pivoted, for example, so that its defined opening is brought into operative association with a key flange associated with the adjustment screw head so as to positionally restrain the upper and lower operating handles when in their closed condition. Alternatively, the handle-restraining system may be embodied in generally U-shaped open channels on the terminal ends of the wings radially extending from the adjustment screw so as to accept a portion of the flange extension associated with the lower operating handle and thereby provide a greater measure against inadvertent separation of the upper and lower handles.

The locking assembly of this invention may also be embodied in a spring-biased locking button associated with the head of the adjustment screw which is adapted to coact with the aperture defined in the extension flange of the lower handle and thereby positionally lock the lower and upper handles one to another. Furthermore, positional locking may be achieved by providing a movable locking member on the extension flange of the lower operating handle which is adapted to be moved into locked and unlocked conditions with respect to one of the openings defined in the adjustment screw when the lower handle is in its closed state.

The extension flange of the lower operating handle will move axially substantially in unison with axial movements of the adjustment screw between greater and lesser positions due to the manner in which the lower operating handle is connected operably to the adjustment screw. As a result, the restraining elements associated with the adjustment screw and the lower operating handle may reliably be brought into alignment with one another when the lower handle is moved to its closed condition. Thus, the handle-restraining systems of this invention allow for positional restraint of the lower and upper handles to be achieved over substantially the entire range of operation of the adjustment screw (and thereby substantially the entire range of clamping forces achievable by the wrench).

Further aspects and advantages of this invention will become more clear after careful consideration is give to the following detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein;

FIG. 5 is a partial side elevational view of an alternative embodiment handle-restraining subassembly associated with a wrench according to the present invention;

FIG. 6 is a cross-sectional elevational view of the handle-restraining subassembly shown in FIG. 5 as taken along line 6—6 therein;

FIG. 7 is an end elevational view of another embodiment of a handle-restraining subassembly according to the present invention;

FIG. 8 is a partial side elevational view of an alternative embodiment of a handle-restraining subassembly according to the present invention which includes an integral locking assembly;

FIG. 9 is a cross-sectional elevational view of the handle-restraining subassembly shown in FIG. 8 as taken along line 9—9 therein;

Figure 16:
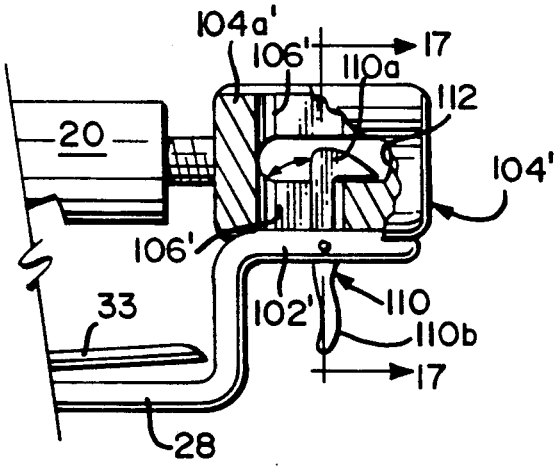
Figure 17:
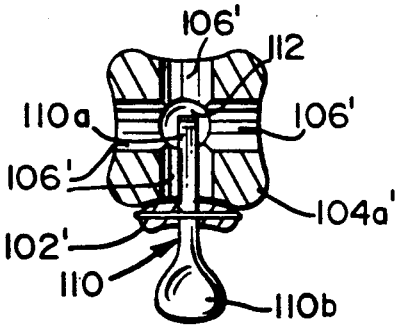

FIG. 16 is a partial side elevational view partly sectioned of a further possible embodiment of a handle-restraining subassembly according to the present invention particularly showing yet another form of an integral handle locking assembly that may be provided; and FIG. 17 is a cross-sectional elevational view of the handle-restraining subassembly shown in FIG. 16 as taken along line 17—17 therein.

DETAILED DESCRIPTION OF THE DRAWINGS

Figure 1:
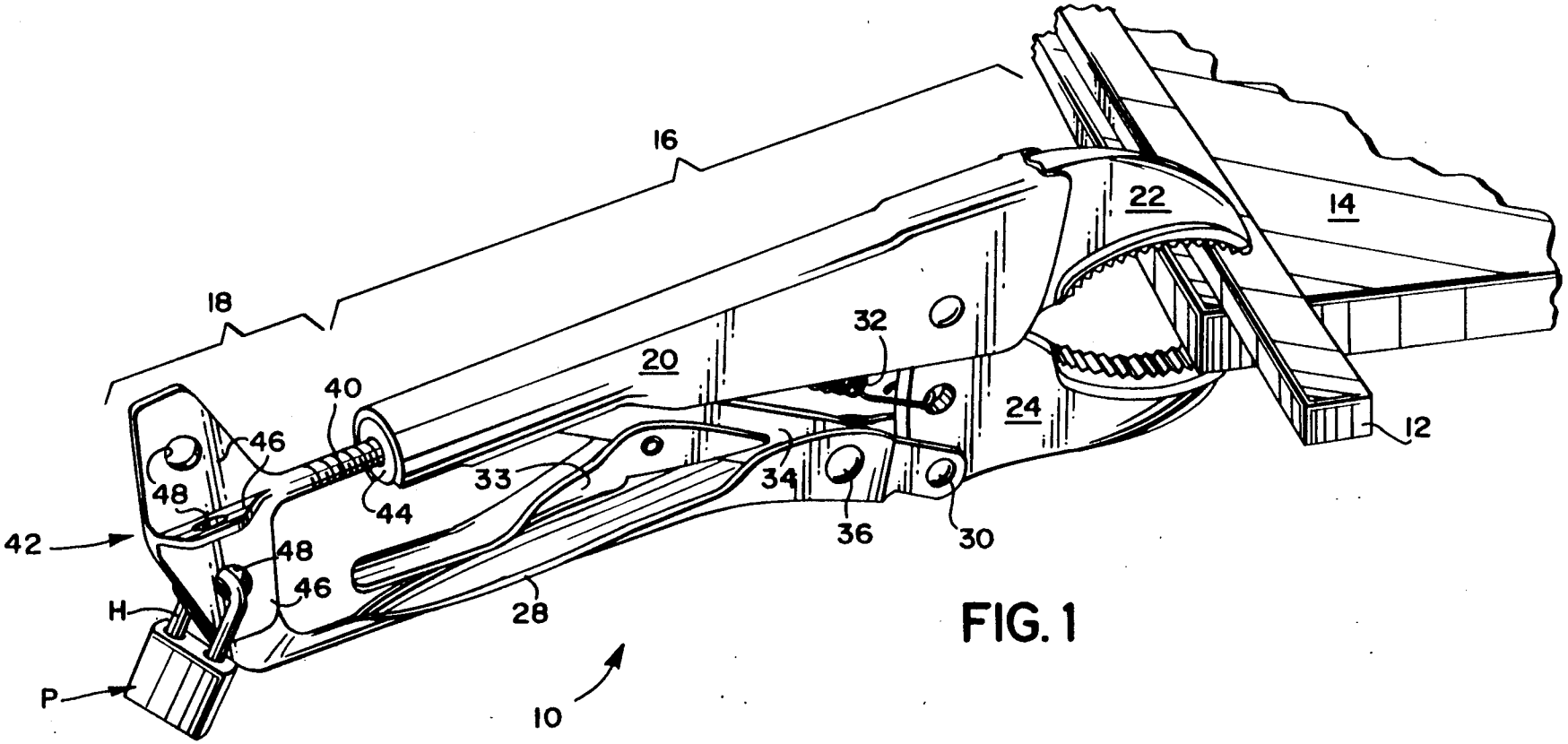
FIG. 1 is a perspective view of a novel locking wrench according to this invention and shown being exemplarily used to clamp bar stock to a work surface.

Accompanying FIG. 1 shows a locking wrench 10 according to the present invention in an exemplary use environment to clamp a piece of bar stock 12 to a work surface 14. The wrench 10 is generally comprised of a forward locking wrench subassembly 16 (which in and of itself is conventional) and a rearward handle-restraining subassembly 18 (which incorporates the modifications according to the present invention).

Figure 2:
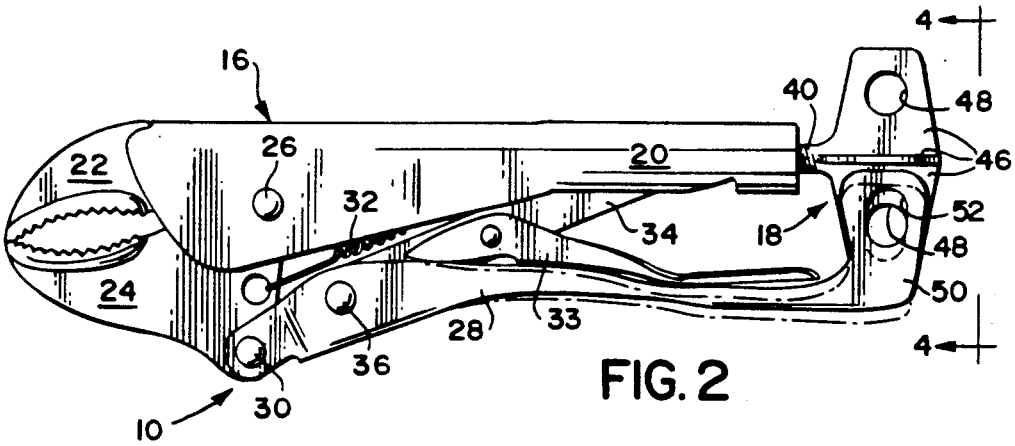
FIG. 2 is a side elevational view of the locking wrench according to the present invention and depicted with the operating handles in a closed condition.
Figure 3:
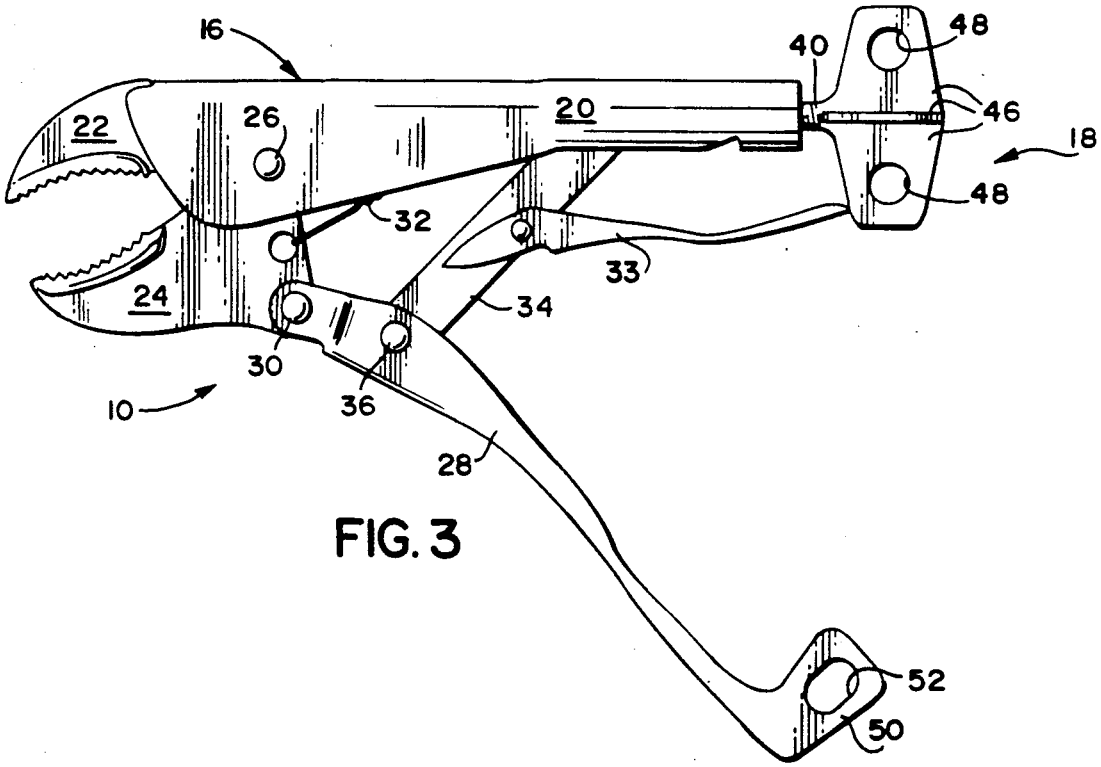
FIG. 3 is a side elevational view of the locking wrench according to the present invention similar to FIG. 2, but shown with the operating handles in an open condition.
Figure 4:
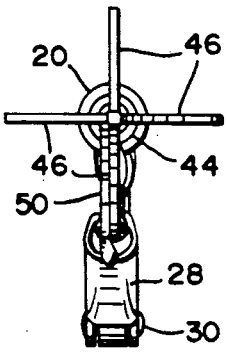
FIG. 4 is an end elevational view of the locking wrench of this invention as taken along line 4—4 in FIG. 2.

As is perhaps more clearly shown in FIGS. 2–4. The locking wrench subassembly 16 includes an upper handle 20 having an upper jaw 22 rigidly fixed to the upper handle 20 at the latter's forward end. A lower jaw 24 is opposed to the upper jaw 22 and is pivotally connected to the upper handle 20 via pivot pin 26. A distal end of the lower operating handle 28 is connected pivotally to the lower jaw 24 at pin 30. Movements of the lower operating handle 28 between its closed condition (i.e., as shown in FIG. 2) and its opened condition (i.e., as shown in FIG. 3) will thereby responsively cause the lower jaw 24 to pivot between respective positions that are closer to and farther from the upper jaw 22.

A tension spring 32 operating between the upper handle 20 and the lower jaw 24 encourages the latter to pivot about pin 26 in a direction which separates the upper and lower jaws 22, 24, respectively (i.e., in a counterclockwise direction as viewed in FIGS. 2 and 3). Optionally, a release lever 33 having a forward operating end portion 33*a* and a rearward grip end portion 33*b* may be pivotally coupled to the toggle lever 34 so as to facilitate release of the clamping force between jaws 22 and 24—that is, to facilitate movement of the operating handle 28 from its closed condition to its opened condition.

A toggle lever 34 extends between the upper handle 20 and the lower operating handle 28. The toggle lever 34 is pivotally connected at one of its ends to the lower operating handle 28 at a pivot pin 36 rearwardly of the pivot pin 30 and is axially slidably received within the upper handle 20 by suitable means (not shown) at the other of its ends.

The threaded shank 40 of adjustment screw 42 is coupled operatively to the threaded sleeve 44 (see FIGS. 1 and 4) which axially extends within the rearward end of the upper handle 20. As is well known in this art, the terminal end of the threaded shank 40 will coact with the toggle lever 34 so as to, in turn, allow the operator to select the clamping force exerted between the upper and lower jaws 22, 24, respectively (i.e., in dependance upon the direction of turning movements applied to the adjustment screw 42).

The improvements according to the present invention are essentially embodied in the handle-restraining subassembly 18. In this regard, the adjustment screw 42 is preferably provided with opposing pairs of radially extending wings 46, each of which preferably defines an opening 48.

The proximal end of the operating handle 28 is provided with a flange extension 50 which defines an aperture 52 therethrough. As can be seen particularly in FIG. 2, the flange 50 moves into adjacent relationship to one of the radially extending wings 46 when the lower handle member 28 is forcibly moved into its closed condition. The aperture 52 defined in the flange extension 50 and the opening 48 defined in that one wing 46 which is adjacent to the flange extension will thereby be aligned to allow a restraining element, for example the hasp H of a conventional padlock P, to pass therethrough and thereby positionally retain the lower handle member in its closed condition. In this manner, the clamping force exerted by the upper and lower jaws 22, 24, respectively, will be maintained. Use of the padlock P as the restraining element will also increase security to minimize theft of objects upon which the wrench 10 is clamped.

It will be appreciated that the structural interrelationship established between the adjustment screw 42 and the lower operating handle 28 by means of the toggle lever 34 causes the extension flange 50 to move axially substantially in unison with axial movements of the adjustment screw 42. That is, when the adjustment screw 42 is turned and thereby moved between greater and lesser axial dimensions relative to the upper handle 20, the structural coupling between the threaded shank 40 of the adjustment screw 42 and the lower operating handle 28 provided by means of the toggle lever 34 will likewise cause the flange 50 to move axially in substantial axial unison therewith. As a result, the aperture 52 defined in the extension flange 50 and the openings 48 defined in the wings 46 of the adjustment screw 42 are capable of being brought into alignment with one another when the lower handle 28 is moved into its closed state.

The lower operating handle 28 usually will have some "play" (as depicted by the chain line representation thereof in FIG. 2) present due to the manner in which the toggle lever 34 and tension spring 32 functionally cooperate. That is, since the tension spring 32 and toggle lever 34 in essence collectively serve as an "over-the-center" assembly, the operating handle 28 will typically be allowed some minor range of opening movement before the clamping force of the jaws 22, 24 is released (i.e., before the force alignment imparted by the tension spring 32 is "over-the-center" of the toggle lever 34). The aperture 52 of the extension flange is thus preferably upwardly elongated (i.e., relative to the upper handle 20) so as to accomodate the "play" that is typically present with the lower operating handle 28.

The restraining element is not necessarily required to effect an absolute rigid union between the upper and lower handles 20, 28, respectively. In other words, since the lower operating handle 28 will usually exhibit some "play" before the clamping force between the jaws 22, 24 is released, it is only important according to the present invention that relative movements between the upper and lower handles 20, 28, respectively, be restrained to the extent of such "play". Because of this, flexible restraining elements such as wire, rope, cable rovings, chain or the like may be used to positionally restrain the upper and lower handle members 20, 28, respectively relative to one another. Thus, according to the present invention, positional handle restraint may be achieved by passing a length of a flexible restraining element through an aligned opening 48 and aperture 52 and then tying or twisting the ends of the flexible element to one another.

As will be understood from the discussion above, therefore, rigid restraining elements other than the padlock hasp H shown in the accompanying drawings could likewise be employed. Thus, for example, rigid bolts, pins, rods, tubing, and the like may be used as the restraining elements according to the present invention.

Although two opposing pairs of wings 46 are shown in the accompanying drawings, greater/lesser numbers of wings may be provided as may be deemed necessary. Thus, if greater "fine" adjustment of the clamping force is desired, then a greater number of wings may be provided, and vice versa. In addition, the flange extension need not be upwardly oriented as shown but could be angled (e.g., L-shaped) or provided in any other desired configuration as long as its aperture and an opening defined in one of the wings 46 are capable of being aligned when the lower operating handle 28 in a closed condition.

In addition to providing the means whereby the upper and lower handles 20, 28, respectively, may be positionally restrained when operatively coupled to the extension flange as described previously, the opposing pairs of radially extending wings 46 define levers of sorts which more easily facilitate manual turning movements applied to the adjustment screw 42.

In this regard, conventional locking-type wrenches usually include a knurled knob at the head of the adjustment screw which is extremely difficult (if not impossible) to operate when the jaws are in a clamped condition. However, because of the lever action provided by the radially extending wings 46, the adjustment screw 42 may be relatively easily turned manually by the operator even when the upper and lower jaws 22, 24 are in a clamped condition (i.e., when the lower operating handle 28 is in a closed condition). Thus, novel locking wrenches according to the present invention may simply be provided with at least one opposing pair of wings 46 in the event the handle restraining functions described previously are not deemed necessary.

The adjustment screw 42 with radially extending wings 46 may also be provided to the market as a "retrofit" item as a replacement for the knurled knob adjustment screw conventionally associated with locking wrenches. Hence, the functional attributes mentioned above can be realized by replacing the conventional knurled knob adjustment screw of those locking wrenches currently in the market with the novel "winged" adjustment screw 42 according to the present invention.

An alternative embodiment of the present invention is shown in accompanying FIGS. 5 and 6. As is seen therein, the extension flange 60 is upwardly and forwardly bent (e.g., generally C-shaped) so as to terminate in an essentially horizontally disposed tail flange **60*a* which defines an aperture 60*b* and is spaced above the lower operating handle 28 by means of upright flange portion 60*c*. The adjustment screw 62 includes a threaded shank portion 62*a* which is threadably coupled to the upper handle 20, and a knurled cylindrical head portion 62*b*. The knurled head portion 62*b* preferably defines a pair of mutually intersecting axially elongate openings 62*c*, 62*d*. A single one of the openings 62*c*, 62*d* or more than a pair of openings 62*c*, 62*d*** may be provided, if desired.

As is perhaps more clearly shown in FIG. 6, the uppermost surface **60*d* of the tail flange 60*a* is concave so as to generally conform to the arcuate external surface of the adjustment screw's head portion 62*b*. In this manner, the tail flange 60*a* and the aperture 60*b* defined thereby may be brought into closely adjacent relationship with the external cylindrical surface of the head portion 62*b* of adjustment screw 62 when the lower operating handle 28 is in its closed state. Thus, one of the openings 62*c*, 62*d* defined by the head portion 62*b* will be capable of being brought into registry with the aperture 60*b*** so that a restraining element may may be passed therethrough in a manner similar to that described previously.

Accompanying FIG. 7 shows one possible modification to the embodiment described above in FIGS. 5-6. In this connection, it will be noted that the head portion **62*b*' of the adjustment screw 62' similarly defines a pair of mutually intersecting apertures 62*c*' and 62*d*' which open onto the valleys between adjacent respective ones of raised longitudinally extending lobes 62*e*'. The lobes 62*e*' serve to facilitate manipulation of the adjustment screw 62'** by the user.

The tail flange **60*a*' of the extension flange 60' defines an aperture 60*b*' therethrough which is adapted to being brought into adjacent registry with one of the openings 62*c*', 62*d*' in a manner similar to that described above in connection with the embodiment shown in FIGS. 5 and 6. It will be observed, however, that the uppermost surface 60*d*' of the tail flange 60*b*' is convexly curved so as to closely match the concave curvature in the valley regions between adjacent lobes 62*e*'. Thus, the tail flange 60*b*' is able to be brought into closely adjacent relationship to the exterior surface in the valley regions between adjacent lobes 62*e*' when the upper and lower handles 20, 28 are in a closed condition so that the aperture 60*b*' and one of the openings 62*c*', 62*d*' may be aligned with one another. It will be appreciated that the cooperation between the convex surface 60*c*' of the tail flange 60*a*' and the valley regions between adjacent lobes 62*e*' will furthermore serve to impede turning movements being applied to the adjustment screw 62' when the handles 20, 28** are in a closed condition.

Accompanying FIGS. 8 and 9 show a further embodiment of a wrench according to the present invention as including an extension flange 70 rearwardly extending from the lower handle 28 and defining a longitudinally oriented slot 72. The adjustment screw 74 includes a threaded shank portion **74*a* which, like the other embodiments described above, is adapted to being threadably coupled axially to the upper handle 20. The adjustment screw 74 also includes a knurled cylindrical knob portion 74*b* and a rearwardly projecting planar key flange 74*c* which defines an opening 74*d*** therethrough.

An rigid retraining element 76 in the form of an elongate loop includes a transverse lower leg **76*a* that extends through the slot 72 of the extension flange 70 and thereby allows the restraining element 76 to be slidably moved in the longitudinal directions established by the slot 72. An intermediate leg 76*b* establishes an elongate opening 76*c* collectively with the upper leg 76*d* of the restraining element 76 which is sized and configured to allow the planar key flange 74*c* to pass therethrough when the restraining element 76 is pivoted into cooperative engagement with the adjustment screw 74**.

It will be noted that the upper and lower handle members 20, 28, respectively will be positionally restrained relative to one another when the key flange **74*c* and restraining element 76 are cooperatively engaged with one another as shown in FIGS. 8 and 9. However, there exists the possibility of disengagement of the key flange 74*c* and restraining element 76. To prevent such disengagement, it is preferred that a supplemental rigid or flexible restraining element (not shown, but of the variety as described above) be passed through the opening 74*d* of the key flange 74*c* when restraining element 76 is cooperatively engaged therewith. In this manner, the restraining element 76 will be captured between the supplemental restraining element and the cylindrical knurled knob 74***b* of the adjustment screw 74 which precludes the restraining element 76 from pivoting out of engagement with the key flange 74*c*.

It is entirely conceivable that a restraining element could be provided as an accessory element for the wrenches of the present invention when sold commercially. And, the restraining element could be provided as an integral part of he wrench, for example, by physically attaching a restraining element to the upper or lower handles 20, 28, respectively, via flexible chain, cord or the like, or via suitable hinge structures so that a restraining element is always available to the operator when the wrench is in use.

Preferably, however, a locking assembly is integrally provided with handle-restraining subassembly according to the present invention so as to provide the wrenches according to this invention with positive locking restraint against the lower operating handle being moved to its opened state. Several exemplary embodiments of such a locking assembly are depicted in accompanying FIGS. 10–17 and are described in greater detail below.

Figure 10:
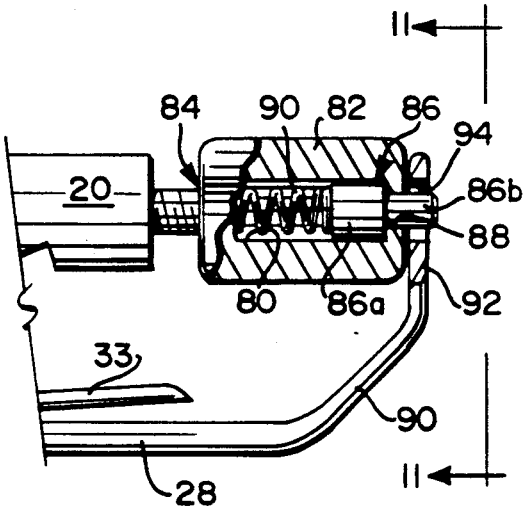
FIG. 10 is a partial side elevational view partly sectioned of another embodiment of a handle-restraining subassembly according to the present invention particularly showing one possible integral handle locking assembly that may be provided.
Figure 11:
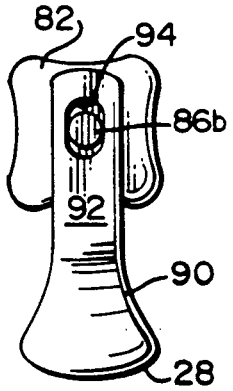
FIG. 11 is an end elevational view of the handle-restraining subassembly shown in FIG. 10 as taken along line 11—11 therein.

As shown in FIGS. 10 and 11, one embodiment of a locking assembly that may be provided includes an axially aligned (i.e., relative to the upper handle 20) interior cavity 80 defined within the head 82 of adjustment screw 84. A locking button 86 is slidably received within the interior cavity 80 and includes a body portion 86*a* and an integral operating button extension 86*b* projecting rearwardly therefrom through an appropriately sized opening 88 defined in the rear end of the adjustment screw head 82. The body portion 86*a* is somewhat enlarged relative to the opening 88 and thereby serves as a stop which establishes the extended position of the locking button 86 as shown in FIG. 10. However, the locking button 86 is capable of being retracted within the cavity 80 against the bias of compression spring 90 by manual pressure being exerted axially against the button extension 86*b*.

The extension flange 92 which extends rearwardly of the lower operating handle 28 includes an upturned flange portion 92 defining an aperture 94. When the operating handle is in its closed state therefore, the aperture 94 will be brought into alignment with the button extension 86*b*. The button extension will thus extend through the aperture 94 so as to prevent the handle 28 from being moved into its opened state and thereby positionally lock the upper and lower handles 20 and 28, respectively. The locking relationship between the upper and lower handles 20 and 28, respectively, may be released simply by exerting an axial force against the button extension 86*b* causing the locking button 86 to retract within the cavity 80 sufficiently to withdraw the button extension 86*b* from the aperture 94.

The axial dimension of the button extension 86*b* is most preferably selected so that upon contact between the upturned flange portion 92 during movement of the lower operating handle 28 to its closed state, the locking button 86 is automatically urged to retract within the interior cavity 80. When the lower operating handle 28 has been moved into its closed state, therefore, the bias of spring 90 will urge the locking button 86 into its normal extended position so that the button extension 86*b* is seated within the aperture 94 defined in the upturned flange portion 92 as shown in FIGS. 10 and 11. To facilitate this operation, the button extension 86*b* and/or the upturned flange portion 92 may be provided with camming surfaces so as to effect locking registry between the button extension 86*b* and the aperture 94 simply by movement of the lower operating handle 28 into its closed state.

Figure 12:
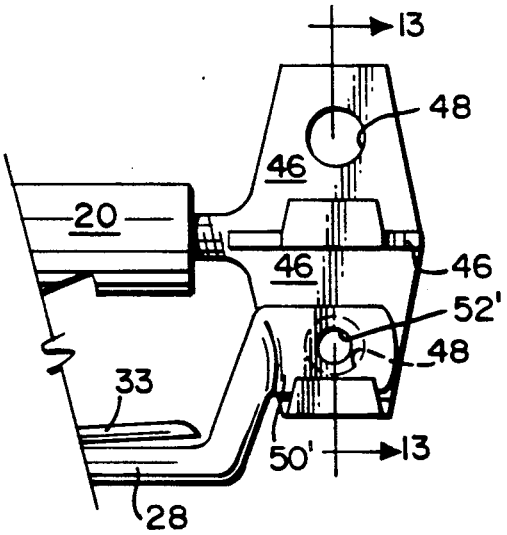
FIG. 12 is a partial side elevational view of another embodiment of a handle-restraining subassembly according to the present invention showing another possible integral handle locking assembly that may be provided therewith.
Figure 13:
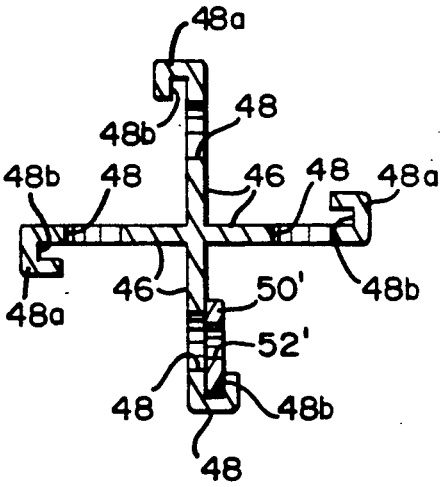
FIG. 13 is a cross-sectional elevational view of the handle-restraining subassembly shown in FIG. 12 as taken along line 13—13 therein.
Figure 14:
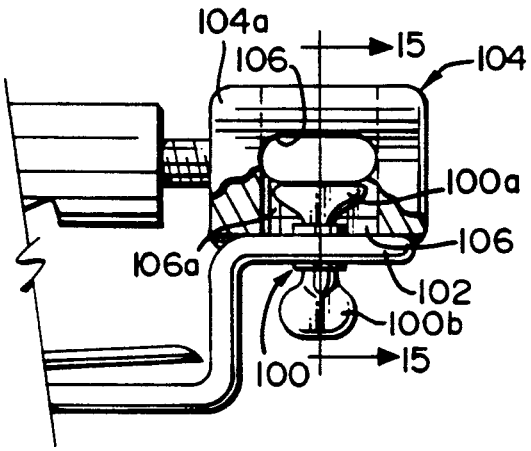
FIG. 14 is a partial side elevational view partly sectioned of yet another embodiment of a handle-restraining subassembly according to the present invention particularly showing a further form of an integral handle locking assembly that may be provided.
Figure 15:
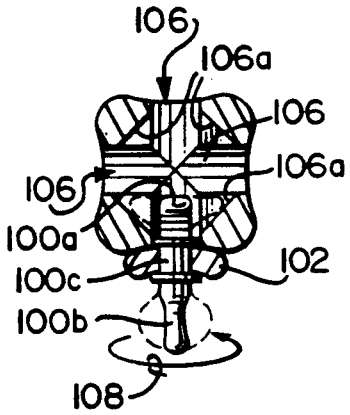
FIG. 15 is a cross-sectional elevational view of the handle-restraining subassembly shown in FIG. 14 as taken along line 15—15 therein.

Another embodiment of a locking assembly according to the present invention is shown in FIGS. 12–13. In this regard, the handle-restraining subassembly is generally similar to that described in connection with FIGS. 1–4 above since the adjustment screw 42 is provided with radially extending wings 46, each of which preferably defines an opening 48. An extension flange 50' similarly defines an aperture 52' which is registerable with one of the apertures 48 defined in a wing 46. According to this embodiment, however, the terminal ends of the wings are provided with generally U-shaped flange seats 48*a* defining open channels 48*b* which are sized and configured to receive a lower edge portion of the extension flange 50' when the operating handle is in its closed state.

As mentioned previously, the lower operating handle 28 will usually have some "play" present when in its closed state. Thus, it will be appreciated that the lower edge of the extension flange 50' may be forcibly moved clear of the flange seats 48*a* when the operating handle 28 is moved to its closed state. In this connection, it is preferred that the adjustment screw be turned slightly so as to establish a small amount of angular mismatch between the extension flange 50' and that wing 46 with which it is to be aligned. Hence, when the operating handle 28 is fully in its closed state, the "play" which is present will allow the extension flange 50' to be forcibly raised sufficiently so the user can turn the adjustment screw 42 and thereby align the extension flange 52' with the respective flange seat 48*a*. Upon release of the lower handle 28, therefore, the extension flange 50' will seat within the channel 48*b* defined by the flange seat (i.e., as shown in FIGS. 12 and 13).

The locking assemblies employed with the handle-restraining systems according to the present invention may also include manually movable locking elements which served to positionally lock the upper and lower handles 20 and 28, respectively one to another. Exemplary embodiments of such locking assemblies are shown in FIGS. 14–15 and 16–17. For example, in the locking assembly depicted in FIGS. 14–15, a turnable locking member 100 is operatively a part of the extension flange 102 of lower handle 28. The locking member 100 includes an upwardly extending locking head 100*a* and a downwardly extending operating head 100 *b* which are integrally connected via a central bearing section 100*c*. The bearing section 100*c* is coupled to the extension flange 102 to allow for relative turning movements of the locking member 100 (which occur, for example, by a user manually grasping and turning the operating head 100*b*).

The head 104*a* of the adjustment screw 104 defines paired axially slotted openings 106 which, in cross-section (see FIG. 15), establishes opposing pairs of beveled bearing surfaces 106*a*. The locking head 100*a* of the locking member 100 may thus be turned so as to be in alignment with the slotted openings 106 defined in the head 104*a* of the adjustment screw 104 to thereby allow the lower operating handle 28 to be moved into its closed state. Thereafter, the operating head 100*b* may be grasped by the user so as to turn the locking member 100 (arrow 108 in FIG. 15). This turning movement of the locking member 100 will responsively cause the locking head to bear against the surfaces 106*a* and thereby prevent separation of the locking head 100 from the slotted opening 106 within which it is seated. As a result, the upper and lower handles 20 and 28 are lockably restrained. Turning movement applied to the operating head 100*b* so as to again opening 106 will thus allow release this locked relationship and allow the lower operating handle 28 to be moved into its opened state.

A further embodiment of the locking assembly that may be provided in accordance with the present invention is shown in accompanying FIGS. 16 and 17. Similar to the embodiment described immediately above with respect to FIGS. 14–15, the embodiment shown in FIGS. 16 and 17 includes an adjustment screw 104' having a head 104*a'* which defines paired axially slotted openings 106'. However, according to the embodiment of FIGS. 16–17 the extension flange 102' includes a pivotal pawl latch 110 integrally having an upper latch head 110*a* and a lower operating lever 110*b*.

The head 104*a'* of the adjustment screw 104' is further provided with an axially aligned rearwardly extending recess 112 adapted to receive a portion of the latch head 110*a* and thereby positionally lock the upper and lower handles 20, 28, respectively, one to another as shown in FIGS. 16 and 17. Preferably, the pawl latch 110 is provided with suitable biasing means (e.g., a torsion spring or the like, not shown) to urge the pawl latch head 110*a* into an engaged position within the recess 112 The slotted openings 106' are sized and configured to receive the latch head 110*a* of the pawl latch 110 when the pivoted latch 110 is pivoted away from the recess 112. In such a manner, the head 110*a* of the pawl latch 110 may enter a slotted opening 106' when the lower operating handle 28 is moved to its closed state so that, thereafter, the latch head 110*a* may be urged into engagement within the recess 112. Preferably the uppermost edge of arcuated camming surface which encourages the latch head 110*a* to automatically pivot away from the recess 112 (preferably against the bias force of a torsion spring, not show) during closure of the handle 28. When the handle 28 has reached its fully closed state, the pawl latch 110 will be pivoted (preferably due to the bias force of the torsion spring, not shown) to cause the latch head 110*a* to seat within the recess 112 and thereby lock the upper and lower handles 20 and 28 one to another.

While a conventional pair of jaws associated with the locking wrenches of this invention has been shown in the accompanying drawings, they are simply representative of any opposing movable members that may be acted upon using a toggle lever according to the general principles of locking-type wrenches. Thus, the term "jaws" as used herein and in the accompanying claims should be interpreted broadly to include any opposing structural member which is otherwise associated with a locking-type wrench of the variety described previously.

Therefore, while the present invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A locking wrench comprising upper and lower handles respectively having upper and lower jaws;

said upper handle having a fixed upper jaw;

said lower handle having a lower jaw movably connected to said lower handle and to said fixed upper jaw so as to be in opposition to said fixed upper jaw such that a clamping force is exerted therebetween, wherein movements of said lower handle between opened and closed states relative to said upper handle causes said lower jaw to be moved relative to said opposing upper jaw between unclamped and clamped conditions, respectively;

a toggle lever pivotally coupled at one end to said lower handle and coupled at another end to said upper handle for axial movements relative to said upper handle;

a release lever having a forward operating end portion and a rearward grip end portion disposed between said upper and lower handles and pivotally connected to said toggle lever for facilitating movement of said lower handle from said closed to said opened states;

an adjustment screw having a rear head portion and a forward threaded shank which is threadably engaged to a rear end of said upper handle to cause axial reciprocal movements of said head portion between greater and lesser positions relative to said rear end of said upper handle in response to turning movements being applied to said adjustment screw, said shank portion of said adjustment screw having a forward end in operative coaction with said another end of said toggle lever such that, in response to axial movement of said adjustment screw between said greater and lesser positions, said operative coaction between said forward end of said adjustment screw and said another end of said toggle lever (i) varies the clamping force exerted between said opposed upper and lower jaws and (ii) causes the lower handle to move axially substantially in unison with said axial movements of said adjustment screw; and a handle retraining system to restrain said lower handle against movement into said opened state when in said closed state, said handle-restraining system including:

(a) an extension flange integral with said lower handle, said extension flange extending upwardly from said lower handle towards said upper handle at a position rearwardly of said grip end portion of said release lever such that a terminal end of said extension flange is in substantial opposed alignment with said head portion of said adjustment screw and such that said extension flange restricts access to said grip end portion of said release lever from a rearward direction; and (b) a restraining element integral with one of said extension flange and said head portion of said adjustment screw; wherein (c) said restraining element and a terminal end of said extension flange remain in said substantial opposed alignment with one another throughout axial movements of said head portion of said adjustment screw between said greater and lesser positions relative to said rear end of said upper handle; and wherein (d) said restraining element and said terminal end of said extension flange are lockably engagable with one another when said lower handle is moved into said closed state relative to said upper handle thereby to positionally restrain said lower handle against movement into said opened state, whereby the clamping force exerted between said upper and lower jaws is maintained.

2. A locking wrench as in claim 1, wherein said extension flange defines an aperture, and wherein said handle-restraining system includes:

a locking button movable within said head portion of said adjustment screw between (i) an extended position in which said locking button is engaged with said aperture when said lower handle is in said closed state to thereby positionally lock said upper and lower handle, and (ii) a retracted position in which said locking button is separated from said aperture to thereby release said upper and lower handles and allow said lower handle to move into said opened state.

3. A locking wrench as in claim 2, including:

an interior cavity formed in said head portion of said adjustment screw;

an opening also formed in said head portion of said adjustment screw and being in communication with said interior cavity; and wherein said locking button includes a body portion slidably received within said interior cavity and an integral operating button extension projecting rearwardly from said body portion through said opening.

4. A locking wrench as in claim 3, wherein said handle-restraining system further includes a spring exerting a bias force against said body portion tending to move said locking button into said extending position.

5. A locking wrench as in claim 1, wherein said adjustment screw includes a number of radially extending wings, wherein said handle-restraining system includes U-shaped flange seats positioned at terminal edges of said wings, said flange seats defining open channels which are sized and configured to receive a lower edge portion of the extension flange when the operating handle is in a closed state.

6. A locking wrench as in claim 1, wherein said handle-restraining system includes:

at least one opening formed in said head portion of said adjustment screw; and wherein said extension flange includes a locking element which is registerable with said at least one opening formed in said adjustment screw when said lower handle is in said closed state, said locking element being movable between a locked position wherein said locking element is lockably engaged within said at least one opening to positionally lock said upper and lower handles, and an unlocked position wherein said locking element is capable of being released from said at least one opening whereby said upper and lower handles may be moved into said opened state thereof.

7. A locking wrench as in claim 6, wherein said at least one opening formed in said head portion of said adjustment screw is axially slotted, and wherein said locking element includes oppositely extending locking and operating heads, and a bearing section integrally joining said locking and operating heads and coupled to said extension flange to allow for turning movements of said locking element.

8. A locking wrench as in claim 7, wherein said at least one slotted opening includes in cross-section as opposed pair of bevelled engagement surfaces which are engaged by said locking head when said locking element is turned to said locked position.

9. A locking wrench as in claim 6, wherein said locking element is pivotally coupled to said extension flange and includes a pawl latch head, and an operating lever extending from said pawl latch head.

10. A locking wrench as in claim 9, wherein said head portion of said adjustment screw defines an interior recess in communication with said at least one opening for receiving a portion of said pawl latch head therewithin to lockable restrain said upper and lower handles.

11. A locking wrench comprising:

an upper handle which includes a fixed upper jaw;

a lower handle;

a lower jaw pivotally connected to said upper handle and to a forward end of said lower handle so as to be in opposition to said fixed upper jaw and capable of pivotal movements towards and away from said fixed upper jaw when said lower handle is respectively moved between closed and opened states;

a toggle lever pivotally coupled at one end to said lower handle rearwardly of said lower jaw, and having an opposite end which is coupled to said upper handle for movements axially relative to said upper handle;

an adjustment screw having a rear head portion and a forward threaded shank portion which is threadably engaged within said upper handle and operatively coacts with the opposite end of said toggle lever, wherein turning movements applied to said adjustment screw causes said head portion of said adjustment screw and said opposite end of said toggle lever to move axially relative to said upper handle thereby causing said one end of said toggle lever to move pivotally relative to said lower handle such that said lower jaw moves pivotally relative to said fixed upper jaw;

a release lever having a forward operating end portion and a rearward grip end portion disposed between said upper and lower handles and pivotally connected to said toggle lever for facilitating movement of said lower handle from said closed to said opened states;

a handle-restraining system for positionally restraining said upper and lower handles in said closed state, said handle-restraining system including a restraining element connecting said rear head portion of said adjustment screw and a rear end of said lower handle at a position rearwardly of said grip end portion of said release lever, said restraining element restricting access to said grip end portion of said release lever from a rearward direction.

12. A locking wrench as in claim 11, further including an extension flange integral with said lower handle, and wherein said handle-restraining system includes apertures formed by said head portion of said adjustment screw and a terminal end of said extension flange of said lower handle, said apertures and said extension flange being registerable with one another when said lower handle is in said closed state, and wherein said restraining element is capable of being passed through registered ones of said apertures, whereby said lower handle is restrained against movement into said opened state.

13. A locking wrench as in claim 11, wherein said lower handle includes an extension flange;

said head portion of said adjustment screw includes at least one opening, and wherein said extension flange is registerable with said at least one opening in said head portion of said adjustment screw when said lower handle is moved into said closed state, and wherein said extension flange includes said restraining element which is movable with said extension flange between a locked position wherein said restraining element is lockably engage within said at least one opening to positionally lock said upper and lower handles, and an unlocked position wherein said restraining element is capable of being released from said at least one opening whereby said lower handle may be moved into said opened state.

14. A locking wrench as in claim 13 wherein said at least one opening defined in said head portion of said adjustment screw is slotted relative to said shank portion of said adjustment screw, and wherein said restraining element includes at a head moving oppositely extending locking and operating head portions, and a bearing section integrally joining said locking and operating portions, said bearing section being joined to said extension flange to allow for turning movements of said restraining element being said locked and unlocked positions.

15. A locking wrench as in claim 14, wherein said at least one slotted opening includes in cross-section an opposed pair of bevelled engagement surfaces which are engaged by said locking portion when said head of said restraining element is turned to said locked position.

16. A restraining wrench as in claim 13, wherein said locking element is pivotally coupled to said flange extension and includes a pawl latch head which is lockably engageable within said at least one opening in said head portion of said adjustment screw, and an operating lever extending from said pawl latch head which is manually operable so as to move said pawl latch head between said locked and unlocked positions.

17. A locking wrench as in claim 1, wherein said rearward end of said lower handle includes an integral extension flange; and wherein an elongate slot is formed in said integral extension flange; and wherein said restraining element has an end which is coupled to said slot for longitudinal and pivotal movements therewithin, and an opposite end having an aperture to accept therewithin at least a part of said adjustment screw head portion.

18. A locking wrench as in claim 17, wherein said adjustment screw includes a key flange, and wherein said aperture accepts said key flange therewithin.

* * * * *